United States Patent [19]

Cloutier

[11] 4,414,464

[45] Nov. 8, 1983

[54] ELECTRICAL WATER HEATING DEVICE WITH IMPROVED INTERNAL CIRCULATION

[76] Inventor: Louis Cloutier, 486 Principale St., Richmond, Comte de Richmond, Quebec, Canada

[21] Appl. No.: 276,759

[22] Filed: Jun. 24, 1981

[51] Int. Cl.[3] ..... F24H 1/20; H05B 3/82

[52] U.S. Cl. ..... 219/312; 122/13 A; 126/362; 219/306; 219/320; 219/341; 237/16

[58] Field of Search ..... 219/306, 307, 310, 312, 219/314, 316, 320, 321, 323, 324, 328, 331, 341; 126/361, 362; 122/13 R, 13 A; 237/16-18

[56] References Cited

U.S. PATENT DOCUMENTS

| | | | |
|---|---|---|---|
| 589,454 | 9/1897 | Winters | 126/362 |
| 1,790,357 | 1/1931 | Stack | 126/361 |
| 1,890,263 | 12/1932 | Parent | 122/13 R |
| 2,344,812 | 4/1944 | Gill . | |
| 2,576,603 | 11/1951 | Hines et al. . | |
| 2,825,791 | 3/1958 | Jackson | 219/323 X |
| 3,277,275 | 10/1966 | Brusven . | |
| 3,353,000 | 11/1967 | Tomlinson . | |
| 3,417,227 | 12/1968 | Barbier et al. . | |
| 3,523,180 | 8/1970 | Kennedy . | |
| 3,538,307 | 11/1970 | Birdwell . | |
| 3,567,905 | 3/1971 | Ferraro . | |
| 3,638,619 | 2/1972 | Hall et al. . | |
| 3,868,494 | 2/1975 | Pepin | 219/341 |

FOREIGN PATENT DOCUMENTS

| | | | |
|---|---|---|---|
| 567297 | 5/1958 | Belgium | 219/310 |
| 475338 | 11/1937 | United Kingdom | 219/312 |
| 524351 | 8/1940 | United Kingdom | 219/312 |

*Primary Examiner*—A. Bartis
*Attorney, Agent, or Firm*—Edwin E. Greigg

[57] ABSTRACT

An electrical water heating device for use in a closed circuit heating system, such as a central heating system, includes a horizontally elongated hollow cylindrical body having a top, bottom and a pair of opposite ends. At least two electric heating elements are mounted opposite to each other on the same horizontal level in the body at both ends thereof and the body has a water outlet and a water inlet centrally located, respectively, in the top and bottom thereof. Two identical T-shaped nozzles are mounted in a symmetrical manner to the inlet and the outlet of the device, respectively, by a short vertical bar of the nozzle. Each nozzle includes elongated closed-end horizontal bar provided with two sets of holes symmetrical with respect to the vertical bar of the nozzle. Each set of holes includes a first hole smaller in diameter than the inner diameter of the horizontal bar and located eccentrically in the closed end of the horizontal bar, a plurality of second holes of the same diameter as the first hole located close to each other in the vicinity of the end of the horizontal bar and each having an axis parallel to that of the vertical bar and three identical third holes each having a diameter smaller than the first and second holes and located along a helicoidal line extending from vertical bar of the nozzle to the second holes with the axis of the second of these third holes extending parallel to the axis of the vertical bar. The size and position of the holes improves circulation of water in the vicinity of the heating elements.

4 Claims, 5 Drawing Figures

ELECTRICAL WATER HEATING DEVICE WITH IMPROVED INTERNAL CIRCULATION

BACKGROUND OF THE INVENTION

The present invention relates to an improved electrical water heating device for use in a closed-circuit heating system such as, for example, a central heating system.

The expression "central heating system" as used hereinafter, includes all the systems in which a liquid, such as water, is circulated through a closed circuit as a heat transfer agent. Such systems generally comprise a heating device in which the liquid is heated, a plurality of radiators connected to the heating device and a pump for circulating the liquid from the heating device to the radiators and vice versa.

That kind of well known heating system presents several practical and economical drawbacks that are associated either to the high coefficient of expansion of the water or, in the particular case of the heating systems using an electrical element to heat the water, the difficulties encountered for obtaining a uniform heating of the liquid inside the device.

Up to now, the first drawback mentioned above has been overcome by using an expansion tank opened to the atmosphere and providing an additional water supply in the circuit to compensate the loss of water that may happen by evaporation. Such an improved system nevertheless involves a permanent control of the level of water in the expansion tank to avoid overheating of the circuit for lack of water. For this reason, it has also been proposed to use a liquid having a very low coefficient of expansion, such as a vegetable or mineral oil, in a conventional heating system to make the presence of an expansion tank unnecessary. The latter arrangement has unfortunately the drawback of being very expensive because of the cost of the oils that can be used.

In order to overcome the second drawback mentioned above, namely the difficulties encountered for obtaining a uniform heating of the liquid inside the device, several electrical devices have been proposed, all provided with baffles or nozzles to increase the period of time during which water is in contact with the electrical elements, or to ensure a better distribution of water at the vicinity of these elements. An example of such an improved electrical heating device is disclosed in the U.S. Pat. No. 3,868,494, issued on Feb. 25, 1975 in the name of A. Pepin.

Unfortunately, none of these known devices has proved to be fully satisfying.

In particular, none of the known devices which comprise a plurality of heating elements obtain uniform heating of water inside the heater if one of the elements fails or is voluntarily inactuated by the consumer when the same decides to lower the heating temperature such as, for example, in the springtime.

None of the known devices ensures perfect circulation of water inside the body of the heater. This results in the presence of cold or warm water zones, located in particular in the corner of the body, and of hot or boiling water zones, located in particular in the middle of the body. The coexistence of such zones of different temperatures leads to thermal shocks that damage the apparatus and may be responsible for the annoying noises that can be heard with almost every known electrical water heating device.

OBJECT AND SUMMARY OF THE INVENTION

An object of the present invention is to provide a new arrangement of elements for electrical heater systems.

Another object of the present invention is to provide an electrical water heating device in which the circulating liquid is uniformly distributed inside the body thereby reducing the risk of thermal shocks and annoying noises.

A further object of the present invention is to provide an electrical water heating device provided with a control system that makes it perfectly safe for use in combination with any kind of central heating system.

The electrical water heating device according to the invention is characterized in that it comprises two identical nozzles mounted in a symmetrical manner at the inlet and outlet of the device, respectively. Each nozzle comprises a first tubular section having a diameter substantially equal to the diameter of the inlet or of the outlet of the device and a second tubular section having substantially the same diameter as the first section, which second section extends perpendicularly to the first section and forms together with it a hollow T-shaped element.

The first section which forms the vertical bar of the "T" is short in length and fixed by one of its ends to the inlet or the outlet of the device. The second section which forms the horizontal bar of the T, is closed at both ends and provided with two sets of holes that are symmetrical with respect to a plane passing through the longitudinal axis of the first section perpendicularly to the axis of the second section. Each set of holes comprises a first circular hole having a diameter smaller in size than the inner diameter of the second section and an axis parallel to that of the second section. This first hole is eccentrically located in each of the closed ends of the second section. Each set of holes also comprises identically shaped, second holes, each having a diameter equal to that of the first hole and an axis parallel to that of the first section, which second holes are located near to each other at the vicinity of the closed end of the second section and open in the same direction as the first section. Each set of holes further comprises three identical third holes each having a diameter smaller than that on the first and second holes, which third holes are located at a short distance from each other near the first section according to a helicoidal line extending from the first section to the closed end of the second section, the axis of the second of these third holes extending parallel to the axis of the first section in the same direction as the latter.

In accordance with the invention, it has been determined that the above-described nozzle structure ensures uniform and complete distribution and circulation of water inside the body of the heater.

An improved efficiency of the electrical water heating device according to the invention apparently results from the eccentrical location of the first holes at both ends of the inlet and outlet nozzles, which ensure projection of the water toward the bottom, lateral ends of the body, together with the suction of the water by like holes at the top of the body. This improved efficiency also results from the helicoidal disposition of the third holes at the surface of the nozzle, which disposition gives a rotary movement to the liquid and thus ensures a better circulation of the same around the electrical heating elements.

According to a preferred embodiment of the invention, the device according to the invention is provided with a control system comprising means for shutting off the electrical circuit that supplies the electrical heater elements if the water level inside the body falls under a predetermined level. This system also comprises means for shutting off the same electrical circuit if the temperature inside the body becomes greater than a predetermined temperature such as the boiling temperature of water, and means for independently controlling the power of each electrical element according to a desired temperature. These control means are preferably all connected to an automatic control panel so that they may be all simultaneously activated in an automatic manner.

The invention will be better understood, and further objects and advantages thereof will become more apparent from the ensuing detailed description of a preferred embodiment taken in conjunction with the drawings.

DETAILED DESCRIPTION

Figure 1:
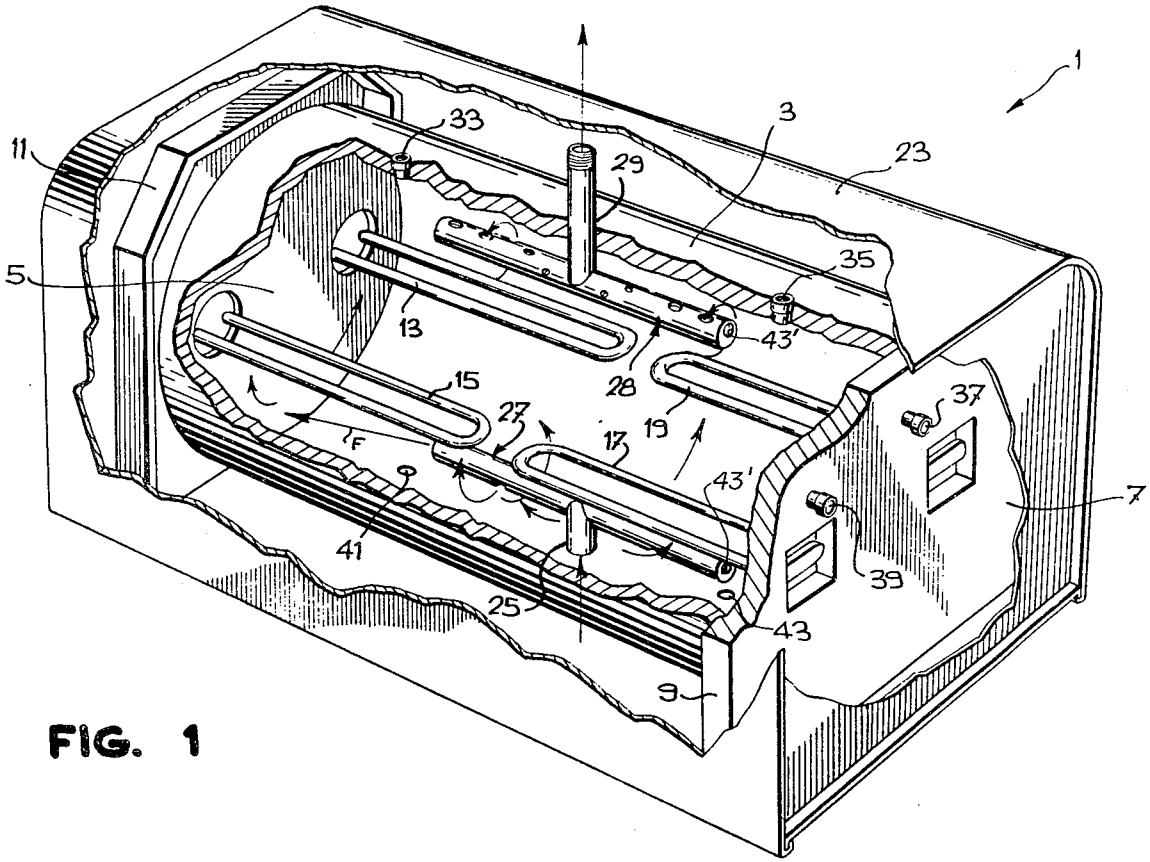
FIG. 1 is a partially cut-away perspective view of an exemplary embodiment of an electrical water heating device according to the invention.

The electrical water heating device 1 shown in FIG. 1 comprises a cylindrical body or barrel 3, horizontally extending inside a protective housing 23. The barrel 3 is made of steel or any other suitable material and is covered with a first reflective layer such as aluminum and with another layer of insulating material (not shown) to minimize the loss of heat. The housing 23 is made of steel plate or any other suitable material and its internal surface can also be covered with one or several insulating layers of any suitable insulating material, if desired.

The barrel 3 is supported in the housing 23 by means of two supports 9 and 11 which are integral parts of the end walls 5 and 7 of the barrel 3. However, it is obvious that any other support could also be used for supporting the barrel 3 inside the housing 23.

The barrel 3 is provided with four electrical heating elements respectively numbered 13, 15, 17 and 19 extending inwardly from the ends 5 and 7. The barrel 3 is provided with a water inlet 25 with an inlet nozzle 27, a water outlet 29 with an outlet nozzle 28, and six openings respectively numbered 33, 35, 37, 39, 41 and 43.

The first opening 33 which is located at the top of the barrel, is designed to receive an over-pressure valve (not shown) working for example over a pressure of 30 pounds.

The second opening 35 which is also located at the top of the barrel, is designed to receive a pressure gauge (not shown) to check the pressure of the liquid inside the system.

The third opening 37, which is located near the top of the end wall 7 of the barrel 3, is designed to receive a probe (not shown) such as that sold by the firm Electronics Corporation of America (Canada) Ltd., which probe is used for automatically shutting off the electrical circuit that supplies the heating elements if the water level inside the barrel falls under a predetermined level. This probe which, contrary to what is generally done, is inserted horizontally inside the barrel instead of being inserted vertically in order to obtain a better precision and therefore a better control, allows the device 1 to be used either in a conventional central heating system provided with an extension tank or in a completely closed heating system using a liquid having a very small coefficient of expansion.

The fourth opening 39 which is located in the left portion of the end wall 7 of the barrel 3 is designed to receive a set of five aquastats (not shown) such as those sold by the firm Honeywell. The first aquastat is used for a safety purpose. Indeed, this aquastat is adjusted to automatically shut off the electrical circuit that supplies the electrical heating elements if the temperature of the liquid inside the barrel becomes greater than a predetermined temperature such as, for example, the boiling temperature of water when water is used as heat transfer liquid. The other aquastats are respectively associated with the four electrical heating elements 13, 15, 17 and 19. These aquastats work independently from each other to reduce or completely shut off the power of each heating element and thus to reduce heating in a continuous manner instead of reducing heating in a sequential manner as is done up to now in the known heating devices. These aquastats may be grouped all together or located at the vicinity of their respective heating elements according to the users requirement.

The fifth opening 41 which is located in the bottom of the barrel 3, is designed to drain the barrel and is usually closed by a plug.

Last of all, the sixth opening 43 which is also located in the bottom of the barrel, is designed for allowing adjustment of the pressure inside the device. This opening is connected to a pressure regulating device which is already known and especially adapted for this purpose.

The heating elements 13, 15, 17 and 19 that are all identical and conventional type, all extend in the same horizontal plane which passes through the axis of the barrel. The elements 13 and 15 extend parallel to each other from the end wall 5 and are connected to the electrical circuit by their external ends. The elements 13 and 15 are located in front of the elements 17 and 19 which extend from the other end wall 7 of the barrel in the same horizontal plane, so as to obtain symmetrical heating and thus to allow the device 1 to be used with only one single heating element.

Figure 2:
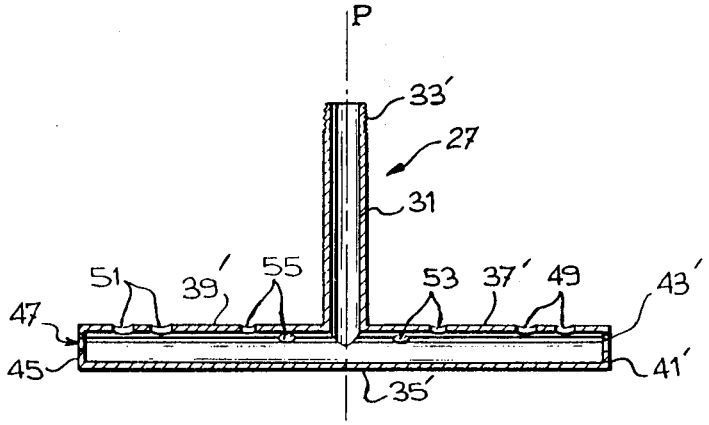
FIG. 2 is a cross-sectional front view of a nozzle of the device shown in FIG. 1.
Figure 3:
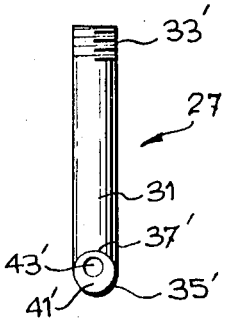
FIG. 3 is an end view of the nozzle shown in FIG. 2.
Figure 4:
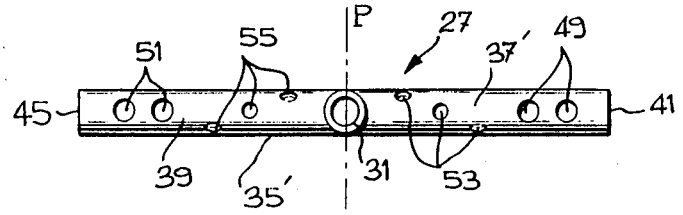
FIG. 4 is a top plane view of the nozzle shown in FIG. 2.

The improved efficiency of the device 1 essentially results from the particular structure of the identical nozzles 27 and 28 in combination with the heater elements and will now be described in detail with reference to FIGS. 2 and 4.

The nozzle 27 which is illustrated, comprises a first tubular section 31 having a diameter substantially equal to the diameter of the inlet 25 of the device 1, and a second tubular section 35' having substantially the same diameter as the first section 31. The second tubular section 35' is fixed, for example by welding, perpendicularly to one end of the first section 31 in such a manner that it communicates with the same and forms a T with it, which T is shown in reversed position in FIG. 2.

The first section 31 which forms the vertical tube of the T is short in length and fixed by its free end 33' to the inlet 25 of the device. Preferably, the first section 31 will be fixed to the inlet 25 by means of an easily removable connection, such as screw threads, to ease its maintenance.

The second tubular section 35' which forms the horizontal tube of the T, comprises two half sections 37' and 39', which are symmetrical and extend integrally with each other. These two half sections 37' and 39' are both closed at their respective ends by two walls 41' and 45 and are provided with two sets of holes or perforations which are symmetrical with respect to a plane P passing through the longitudinal axis of the first section 31 perpendicularly to the axis of the second section 35'. Each set of holes comprises a first hole 43' or 47 in ends 41' and 45 having an axis parallel to that of the second section 35' but a diameter smaller than the inner diameter of the first and second sections. This first hole is eccentrically located on the ends 41' or 45 near the surface toward the first section 31, that is positioned near the bottom of the barrel, in order to project the liquid passing through the nozzle at both ends thereof toward the bottom corners of the device, as shown by arrow F on FIG. 1, and thus to stir up the liquid in the ends and corners of the device to obtain a better thermal distribution.

Each set of holes also comprises an additional pair of identically shaped, circular holes 49 or 51, each having a diameter equal to that of the first holes 43' or 47. These holes 49 or 51 each have an axis parallel to that of the first section and are located near each other in the vicinity of the closed ends 41' or 45 of the second section 35', respectively. These holes 49 or 51 are both opened in the same direction as the first section, that is, toward the bottom of the barrel, and they act as main outlets for the liquid that circulates through the nozzle. The flow of liquid that exits from these holes 49 or 51 is projected toward the bottom of the barrel 3 and thus improves stirring up the liquid inside the device.

Each set of holes comprises an additional set of three identical, circular holes 53 or 55, each having a diameter substantially smaller than that of the holes 49 or 51. These smaller holes 53 or 55 are located at a short distance from each other between the first section and the holes 49 or 51, according to a helicoidal line starting from the first section 31 to the closed ends 41' or 45 of the second section 35'. The smaller holes 53 or 55 are located in such a manner that they open in the same direction as the first section, that is toward the bottom of the barrel, the axis of the second of the three holes extending parallel to the axis of the first section 31. These small holes serve to create not only the suitable turbulence inside the device 1 but also a rotary movement of the liquid inside the barrel about the horizontal axis of the same, owing to the symmetrical arrangement of the holes with respect to the plane P.

In accordance with the particular embodiment, the nozzles 27 and 28 are made of steel tubing or any other suitable material having a diameter of about one inch. The second section 35' has a length of about 14.5 inches. The holes 43', 47, 49 and 51 have a diameter of 0.5 inch while the holes 53 and 55 have a diameter of 0.25 inch.

The length of the first section 31 depends on the general shape of the device and more especially, the depth at which the nozzles 27 and 28 extend inside the barrel. Preferably, these nozzles will be located in such a manner that their second section 35' is at about 0.75 inch from the bottom or top of the barrel to effectively "break" the flow of liquid passing through the holes.

The nozzles 27 and 28 ensure an excellent circulation and distribution of the liquid inside the device, and more particularly about the heating elements 13, 15, 17 and 19 with the following advantages.

First of all, the excellent distribution of the liquid reduces and even completely prevents the thermal shocks between cold and hot water zones inside the barrel and thus permits considerably reducing the noises that result from these shocks.

This excellent distribution also permits use of the device 1 with four, three, two or even one heating element, without reduction in efficiency. This characteristic is particularly advantageous as it allows easy adjustment of the heating power of the device and it also permits operation of the device in a continuous manner rather than operating it in a sequential manner when low heating is required. Instead of connecting the four heating elements together electrically for a very short period of time to heat the water at the desired temperature, and then switching them off before connecting them on again, one can connect only one or two heating elements together which then operate alternately in an almost continuous manner with the same efficiency.

Figure 5:
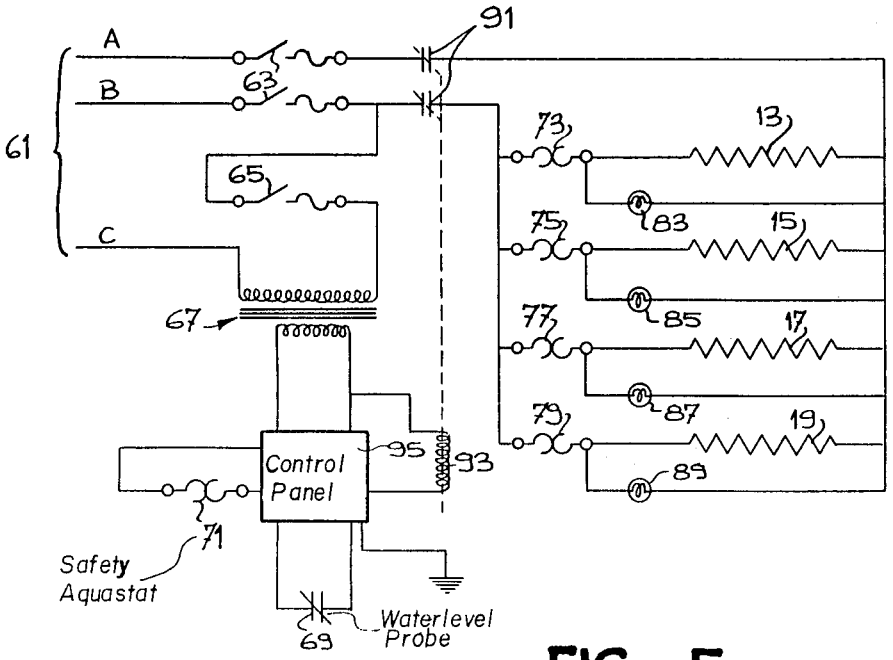
FIG. 5 is an electrical diagram of the control system for the device shown in FIG. 1.

FIG. 5 of the drawings is a diagram of an electrical circuit that can be used for supplying current to the four heating elements and controlling them by means of any desired electrical devices.

The illustrated circuit is supplied by a three-conductor current source 61. The electrical heating elements 13, 15, 17 and 19 that each have from 1 to 6 kw power, are mounted in parallel between two wires A and B of the power supply network. An aquastat 73, 75, 77 and 79 is associated with each heating element 13, 15, 17 and 19, respectively. As aforesaid, each aquastat works independently from each other. A pilot lamp 83, 85, 87 and 89 is also mounted in parallel to each heating element, respectively. The wires A and B are each provided with a manual breaker 63 and with contactors 91 to shut off the heating elements.

A 120 V–24 V transformer 67 is mounted between the wire B and the third wire C of the power supply network, in series with another manual breaker 65. This transformer is used for supplying an automatic control panel 95 with a 24 V current. The control panel 95 which can be of the type sold under the trademark ELECTROMATIC SV 115-024, is used for shutting off the electrical heating circuit if the level of liquid inside the barrel falls under a predetermined level or if the temperature inside the barrel becomes greater than a maximum predetermined value of, for example, 100° C. if the liquid used in the central heating system is water.

To perform this function, the control panel 95 is connected to a fifth safety aquastat 71 and to a probe 69 inserted inside the barrel through the opening 37 as has been described above. The control panel is also connected to the contactor 91 by a relay 93. The contactor 91 and the relay 93 are generally made in one piece, such as that sold under the trademark STA by the firm Industrial Timer Division. The control panel is further connected to the ground, in a conventional manner.

In operation, manual operation of the breakers 63 and 65 closes both the heating circuit, including the heating elements 13, 15, 17 and 19, and the safety circuit including the control panel 95 that is connected to the aquastat 71 and probe 69.

If the temperature inside the barrel becomes too high or the level of the liquid falls under a predetermined level, the aquastat 71 or probe 69 transmits a signal to the control panel which, in turn, automatically operates the relay 93 for shutting off the heating circuit by the switch 91, thus avoiding any accident due to overheating of the whole system and more particularly of the heating device forming part of the system.

The circuit can then be closed again by adding water inside the barrel until the probe 69 is again fully immersed or by waiting until the temperature inside the barrel has fallen down under the critical level.

Preferably, use will be made of a safety aquastat 71 that can be reset only by hand, to improve the safety of the whole system.

The electrical circuit permits one to use the above-described heating device 1 in any kind of electrical heating system in a perfectly safe manner.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. In an improved electrical water heating device of the type comprising a horizontal elongated hollow body having a top, a bottom, and a pair of opposite ends, at least two heating elements mounted opposite each other at the same horizontal level in the body at both ends thereof, a water inlet centrally located in the bottom of the body and a water outlet having the same diameter as said inlet centrally located in the top of the body, the improvement comprising first and second identical nozzles mounted in said body in a symmetrical manner, said first nozzle connected to said inlet and said second nozzle connected to said outlet of the device, each of said first and second nozzles comprising a first vertical tubular section having a diameter substantially equal to the diameter of said inlet and outlet of the device, respectively, and a second horizontal tubular section connected to and having substantially the same diameter as the first tubular section, said second tubular section extending perpendicularly to one end of the first tubular section and connected thereto at its midpoint to form together with said first tubular section a hollow T-shaped element;

the other end of said first tubular section of one of the first and second nozzles being connected to the inlet and the other end of the first tubular section of the other nozzle being connected to the outlet, said second section which forms the horizontal bar of the T being closed at both ends and provided with two sets of holes that are symmetrical with respect to a plane passing through the longitudinal axis of the first section perpendicularly to the axis of the second section;

each set of holes in said second tubular section comprising a pair of first circular holes, each having a diameter smaller than the inner diameter of the second section and on an axis parallel to that of the second section, one of said first holes being eccentrically located on each closed end of the second section, said set of holes also comprising identically shaped second holes, each having a diameter equal to that of the first hole and an axis parallel to the longitudinal axis of the first section, said second holes being located close to each other at the vicinity of the closed ends of the second section and opening in the same direction as the first section, each set of holes further comprising three identical third holes each having a diameter smaller than that of the first and second holes, said third holes being located a short distance from each other according to a helicoidal line extending from the first section toward the closed end of the second section, the axis of the second of said third holes extending parallel to the longitudinal axis of the first section and opening in the same direction as the latter.

2. An electrical water heating device as claimed in claim 1, wherein said pair of first holes are located on the ends nearer the surface of said second section to which said first section is secured.

3. An electrical water heating device as claimed in claim 1, wherein the body is of cylindrical shape and located inside a protective housing.

4. An electrical water heating device according to claim 1, further comprising a control system comprising means for shutting off an electrical circuit that supplies the electrical elements if the water level inside the body falls under a predetermined level, means for shutting off said electrical circuit if the temperature inside the body becomes greater than a predetermined temperature, and means for independently controlling the power of each electrical element according to a desired temperature.

* * * * *